US007252756B2

(12) United States Patent
Gong et al.

(10) Patent No.: US 7,252,756 B2
(45) Date of Patent: Aug. 7, 2007

(54) PREPARATION OF COMPONENTS FOR REFINERY BLENDING OF TRANSPORTATION FUELS

(75) Inventors: William H. Gong, DuPage, IL (US); Larry W. Kruse, Donnellson, IA (US); George A. Huff, DuPage, IL (US); Michael Muskett, Hull (GB)

(73) Assignee: BP Corporation North America Inc., Warrenville, IL (US)

( * ) Notice: Subject to any disclaimer, the term of this patent is extended or adjusted under 35 U.S.C. 154(b) by 658 days.

(21) Appl. No.: 10/323,215

(22) Filed: Dec. 18, 2002

(65) Prior Publication Data

US 2004/0118750 A1 Jun. 24, 2004

(51) Int. Cl.
*C10G 29/22* (2006.01)

(52) U.S. Cl. ..... 208/240; 208/211; 208/212; 208/219; 208/220; 208/222; 208/223; 208/224; 585/833

(58) Field of Classification Search ..... 208/211, 208/212, 219, 220, 221, 222, 223, 224, 240; 585/833
See application file for complete search history.

(56) References Cited

U.S. PATENT DOCUMENTS 3,792,095 A 2/1974 Burmistrova et al. ... 260/607 A
6,160,193 A 12/2000 Gore ..... 585/833
6,171,478 B1 1/2001 Cabrera et al. ..... 208/212
6,596,914 B2 * 7/2003 Gore et al. ..... 585/833
2002/0035306 A1 3/2002 Gore et al.

FOREIGN PATENT DOCUMENTS

WO 02092726 11/2002
WO 02097006 12/2002

* cited by examiner

*Primary Examiner*—Tam M. Nguyen
(74) *Attorney, Agent, or Firm*—Ekkehard Schoettle

(57) ABSTRACT

A process is disclosed for the production of refinery transportation fuel or components for refinery blending of transportation fuels having a reduced amount of sulfur and/or nitrogen-containing impurities. The process involves contacting a hydrocarbon feedstock containing the above impurities with an immiscible phase containing hydrogen peroxide and acetic acid in an oxidation zone to selectively oxidize the impurities. After a gravity phase separation, the hydrocarbon phase containing any remaining oxidized impurities, is passed to an extraction zone wherein aqueous acetic acid is used to extract a portion of any remaining oxidized impurities. A hydrocarbon stream having reduced impurities can then be recovered. The acetic acid phase effluents from the oxidation and the extraction zones can then be passed to a common separation zone for recovery of the acetic acid and for optional recycle back to the oxidation and extraction zones.

13 Claims, 6 Drawing Sheets

Post-Oxidation Sulfur Concentration in Oxidation Effluent

Post-Extraction Sulfur Concentration in Extraction Effluent

Difference Between Oxidation Stage Sulfur and Extraction Stage Sulfur in 1 wt% Phosphoric Acid Catalyzed Process

Difference Between Oxidation Stage Sulfur and Extraction Stage Sulfur in Non-Acid Catalyzed

Post-Oxidation Stage Nitrogen Concentration

PREPARATION OF COMPONENTS FOR REFINERY BLENDING OF TRANSPORTATION FUELS

FIELD OF THE INVENTION

The present invention relates to fuels for transportation which are derived from natural petroleum, particularly processes for the production of components for refinery blending of transportation fuels which are liquid at ambient conditions. More specifically, it relates to an integrated process which includes selective oxidation of a petroleum distillate in order to oxidize sulfur-containing organic compounds, and/or nitrogen-containing organic compounds and includes an extraction step whereby such sulfur-containing and nitrogen-containing compounds are removed from the distillate in order to recover components for refinery blending of transportation fuels which are friendly to the environment.

BACKGROUND OF THE INVENTION

It is well known that internal combustion engines have revolutionized transportation following their invention during the last decades of the 19th century. While others, including Benz and Gottleib Wilhelm Daimler, invented and developed engines using electric ignition of fuel such as gasoline, Rudolf C. K. Diesel invented and built the engine named for him which employs compression for auto-ignition of the fuel in order to utilize low-cost organic fuels. Development of improved diesel engines for use in transportation has proceeded hand-in-hand with improvements in diesel fuel compositions. Modern high performance diesel engines demand ever more advanced specification of fuel compositions, but cost remains an important consideration.

At the present time most fuels for transportation are derived from natural petroleum. Indeed, petroleum as yet is the world's main source of hydrocarbons used as fuel and petrochemical feedstock. While compositions of natural petroleum or crude oils are significantly varied, all crudes contain sulfur compounds and most contain nitrogen compounds which may also contain oxygen, but oxygen content of most crudes is low. Generally, sulfur concentration in crude is less than about 8 percent, with most crudes having sulfur concentrations in the range from about 0.5 to about 1.5 percent. Nitrogen concentration is usually less than 0.2 percent, but it may be as high as 1.6 percent.

Crude oil seldom is used in the form produced at the well, but is converted in oil refineries into a wide range of fuels and petrochemical feedstocks. Typically fuels for transportation are produced by processing and blending of distilled fractions from the crude to meet the particular end use specifications. Because most of the crudes available today in large quantity are high in sulfur, the distilled fractions must be desulfurized to yield products which meet performance specifications and/or environmental standards. Sulfur containing organic compounds in fuels continues to be a major source of environmental pollution. During combustion they are converted to sulfur oxides which, in turn, give rise to sulfur oxyacids and, also, contribute to particulate emissions.

Even in newer, high performance diesel engines combustion of conventional fuel produces smoke in the exhaust. Oxygenated compounds and compounds containing few or no carbon-to-carbon chemical bonds, such as methanol and dimethyl ether, are known to reduce smoke and engine exhaust emissions. However, most such compounds have high vapor pressure and/or are nearly insoluble in diesel fuel, and they have poor ignition quality, as indicated by their cetane numbers. Furthermore, other methods of improving diesel fuels by chemical hydrogenation to reduce their sulfur and aromatics contents, also cause a reduction in fuel lubricity. Diesel fuels of low lubricity may cause excessive wear of fuel injectors and other moving parts which come in contact with the fuel under high pressures.

Distilled fractions used for fuel or a blending component of fuel for use in compression ignition internal combustion engines (Diesel engines) are middle distillates that usually contain from about 1 to 3 percent by weight sulfur. In the past a typical specifications for Diesel fuel was a maximum of 0.5 percent by weight. By 1993 legislation in Europe and United States limited sulfur in Diesel fuel to 0.3 weight percent. By 1996 in Europe and United States, and 1997 in Japan, maximum sulfur in Diesel fuel was reduced to no more than 0.05 weight percent. This world-wide trend must be expected to continue to even lower levels for sulfur.

In one aspect, pending introduction of new emission regulations in California and other jurisdictions has prompted significant interest in catalytic exhaust treatment. Challenges of applying catalytic emission control for the diesel engine, particularly the heavy-duty diesel engine, are significantly different from the spark ignition internal combustion engine (gasoline engine) challenges due to two factors. First, the conventional three way catalyst (TWC) catalyst is ineffective in removing NOx emissions from diesel engines, and second, the need for particulate control is significantly higher than with the gasoline engine.

Several exhaust treatment technologies are emerging for control of Diesel engine emissions, and in all sectors the level of sulfur in the fuel affects efficiency of the technology. Sulfur is a catalyst poison that reduces catalytic activity. Furthermore, in the context of catalytic control of Diesel emissions, high fuel sulfur also creates a secondary problem of particulate emission, due to catalytic oxidation of sulfur and reaction with water to form a sulfate mist. This mist is collected as a portion of particulate emissions.

Compression ignition engine emissions differ from those of spark ignition engines due to the different method employed to initiate combustion. Compression ignition requires combustion of fuel droplets in a very lean air/fuel mixture. The combustion process leaves tiny particles of carbon behind which leads to significantly higher particulate emissions than are present in gasoline engines. Due to the lean operation the CO and gaseous hydrocarbon emissions are significantly lower than the gasoline engine. However, significant quantities of unburned hydrocarbon are adsorbed on the carbon particulate. These hydrocarbons are referred to as SOF (soluble organic fraction). A root cause of health concerns over diesel emissions can be traced to the inhalation of these very small carbon particles containing toxic hydrocarbons deep into the lungs.

While an increase in combustion temperature can reduce particulate, this leads to an increase in NOx emission by the well-known Zeldovitch mechanism. Thus, it becomes necessary to trade off particulate and NOx emissions to meet emissions legislation.

Available evidence strongly suggests that ultra-low sulfur fuel is a significant technology enabler for catalytic treatment of diesel exhaust to control emissions. Fuel sulfur levels of below 15 ppm, likely, are required to achieve particulate levels below 0.01 g/bhp-hr. Such levels would be very compatible with catalyst combinations for exhaust treatment now emerging, which have shown capability to achieve NOx emissions around 0.5 g/bhp-hr. Furthermore, NOx trap systems are extremely sensitive to fuel sulfur and available evidence suggests that they would need sulfur levels below 10 ppm to remain active.

In the face of ever-tightening sulfur specifications in transportation fuels, sulfur removal from petroleum feedstocks and products will become increasingly important in years to come. While legislation on sulfur in diesel fuel in Europe, Japan and the U.S. has recently lowered the specification to 0.05 percent by weight (max.), indications are that future specifications may go far below the current 0.05 percent by weight level.

Conventional hydrodesulfurization (HDS) catalysts can be used to remove a major portion of the sulfur from petroleum distillates for the blending of refinery transportation fuels, but they are not efficient for removing sulfur from compounds where the sulfur atom is sterically hindered as in multi-ring aromatic sulfur compounds. This is especially true where the sulfur heteroatom is doubly hindered (e.g., 4,6-dimethyidibenzothiophene). These hindered dibenzothiophenes predominate at low sulfur levels such as 50 to 100 ppm and would require severe process conditions to be desulfurized. Using conventional hydrodesulfurization catalysts at high temperatures would cause yield loss, faster catalyst coking, and product quality deterioration (e.g., color). Using high pressure requires a large capital outlay.

In order to meet stricter specifications in the future, such hindered sulfur compounds will also have to be removed from distillate feedstocks and products. There is a pressing need for economical removal of sulfur from distillates and other hydrocarbon products.

The art is replete with processes said to remove sulfur from distillate feedstocks and products. One known method involves the oxidation of petroleum fractions containing at least a major amount of material boiling above very high-boiling hydrocarbon materials (petroleum fractions containing at least a major amount of material boiling above about 550° F.) followed by treating the effluent containing the oxidized compounds at elevated temperatures to form hydrogen sulfide (500° F. to 1350° F.) and/or hydroprocessing to reduce the sulfur content of the hydrocarbon material. See, for example, U.S. Pat. No. 3,847,798 (Jin Sun Yoo, et al) and U.S. Pat. No. 5,288,390 (Vincent A. Durante). Such methods have proven to be of only limited utility since only a rather low degree of desulfurization is achieved. In addition, substantial loss of valuable products may result due to cracking and/or coke formation during the practice of these methods. Therefore, it would be advantageous to develop a process which gives an increased degree of desulfurization while decreasing cracking or coke formation.

Several different oxygenation methods for improving fuels have been described in the past. For example, U.S. Pat. No. 2,521,698 (G. H. Denison, Jr. et al.) describes a partial oxidation of hydrocarbon fuels as improving cetane number. This patent suggests that the fuel should have a relatively low aromatic ring content and a high paraffinic content. U.S. Pat. No. 2,912,313 (James B. Hinkamp et al.) states that an increase in cetane number is obtained by adding both a peroxide and a dihalo compound to middle distillate fuels. U.S. Pat. No. 2,472,152 (Adalbert Farkas et al.) describes a method for improving the cetane number of middle distillate fractions by the oxidation of saturated cyclic hydrocarbon or naphthenic hydrocarbons in such fractions to form naphthenic peroxides. This patent suggests that the oxidation may be accelerated in the presence of an oil-soluble metal salt as an initiator, but is preferably carried out in the presence of an inorganic base. However, the naphthenic peroxides formed are deleterious gum initiators. Consequently, gum inhibitors such as phenols, cresols and cresyic acids must be added to the oxidized material to reduce or prevent gum formation. These latter compounds are toxic and carcinogenic.

U.S. Pat. No. 4,494,961 (Chaya Venkat et al.) relates to improving the cetane number of raw, untreated, highly aromatic, middle distillate fractions having a low hydrogen content by contacting the fraction at a temperature of from 50° C. to 350° C. and under mild oxidizing conditions in the presence of a catalyst which is either (i) an alkaline earth metal permanganate, (ii) an oxide of a metal of Groups IB, IIB, IIIB, IVB, VB, VIB, VIIB or VIIIB of the periodic table, or a mixture of (i) and (ii). European Patent Application 0 252 606 A2 also relates to improving the cetane rating of a middle distillate fuel fraction which may be hydro-refined by contacting the fraction with oxygen or oxidant, in the presence of catalytic metals such as tin, antimony, lead, bismuth and transition metals of Groups IB, IIB, VB, VIB, VIIB and VIIIB of the periodic table, preferably as an oil-soluble metal salt. The application states that the catalyst selectively oxidizes benzylic carbon atoms in the fuel to ketones.

U.S. Pat. No. 4,723,963 (William F. Taylor) suggests that cetane number is improved by including at least 3 weight percent oxygenated aromatic compounds in middle distillate hydrocarbon fuel boiling in the range of 160° C. to 400° C. This patent states that the oxygenated alkylaromatics and/or oxygenated hydroaromatics are preferably oxygenated at the benzylic carbon proton.

U.S. Pat. No. 6,087,544 (Robert J. Wittenbrink et al.) relates to processing a distillate feedstream to produce distillate fuels having a level of sulfur below the distillate feedstream. Such fuels are produced by fractionating a distillate feedstream into a light fraction, which contains only from about 50 to 100 ppm of sulfur, and a heavy fraction. The light fraction is hydrotreated to remove substantially all of the sulfur therein. The desulfurized light fraction, is then blended with one half of the heavy fraction to product a low sulfur distillate fuel, for example 85 percent by weight of desulfurized light fraction and 15 percent by weight of untreated heavy fraction reduced the level of sulfur from 663 ppm to 310 ppm. However, to obtain this low sulfur level only about 85 percent of the distillate feedstream is recovered as a low sulfur distillate fuel product.

U.S. patent application Publication Ser. No. 2002/0,035,306 A1 (Gore et al.) discloses a multi-step process for desulfurizing liquid petroleum fuels that also removes nitrogen-containing compounds and aromatics. The process steps are thiophene extraction; thiophene oxidation; thiophene-oxide and dioxide extraction; raffinate solvent recovery and polishing; extract solvent recovery; and recycle solvent purification.

The Gore et al. process seeks to remove 5–65% of the thiophenic material and nitrogen-containing compounds and parts of the aromatics in the feedstream prior to the oxidation step. While the presence of aromatics in diesel fuel tends to suppress cetane, the Gore et al. process requires an end use for the extracted aromatics. Further, the presence of an effective amount of aromatics serves to increase the fuel density (Btu/gal) and enhance the cold flow properties of diesel fuel. Therefore it is not prudent to extract an inordinate amount of the aromatics.

With respect to the oxidation step, the oxidant is prepared in situ or is previously formed. Operating conditions include a molar ratio of $H_2O_2$ to S between about 1:1 and 2.2:1; acetic acid content between about 5 and 45% of feed, solvent content between 10 and 25% of feed, and a catalyst volume of less than about 5,000 ppm sulfuric acid, preferably less than 1,000 ppm. Gore et al. also discloses the use of an acid catalyst in the oxidation step, preferably sulfuric acid. The use of sulfuric acid as an oxidizing acid is problematic in that corrosion is a concern when water is present and hydrocarbons can be sulfonated when a little water is present.

According to Gore et al. the purpose of the thiophene-oxide and dioxide extraction step is to remove more than 90% of the various substituted benzo and dibenzo thiophene-oxides and N-oxide compounds plus a fraction of the aromatics with an extracting solvent that is aqueous acetic acid with one or more co-solvents.

U.S. Pat. No. 6,368,495 B1 (Kocal et al.) also discloses a multi-step process for the removal of thiophenes and thiophene derivatives from petroleum fractions. This subject process involves the steps of contacting a hydrocarbon feed stream with an oxidizing agent followed by the contact of the oxidizing step effluent with a solid decomposition catalyst to decompose the oxidized sulfur-containing compounds thereby yielding a heated liquid stream and a volatile sulfur compound. The subject patent discloses the use of oxidizing agents such as alkyl hydroperoxides, peroxides, percarboxylic acids, and oxygen.

WO 02/18518 A1 (Rappas et al) discloses a two-stage desulfurization process which is utilized downstream of a hydrotreater. The process involves an aqueous formic acid based, hydrogen peroxide biphasic oxidation of a distillate to convert thiophenic sulfur to corresponding sulfones. During the oxidation process, some sulfones are extracted into the oxidizing solution. These sulfones are removed from the hydrocarbon phase by a subsequent phase separation step. The hydrocarbon phase containing remaining sulfones is then subjected to a liquid-liquid extraction or solid adsorption step.

The use of formic acid in the oxidation step is not advisable. Formic acid is relatively more expensive than acetic acid. Further, formic acid is considered a "reducing" solvent and can hydride certain metals thereby weakening them. Therefore, exotic alloys are required to handle formic acid. These expensive alloys would have to be used in the solvent recovery section and storage vessels. The use of formic acid also necessitates the use of high temperatures for the separation of the hydrocarbon phase from the aqueous oxidant phase in order to prevent the appearance of a third precipitated solid phase. It is believed this undesirable phase can be formed due to the poor lipophilicity of formic acid. Therefore at lower temperatures, formic acid cannot maintain in solution some of the extracted sulfones.

U.S. Pat. No. 6,171,478 B1 (Cabrera et al.) discloses yet another complex multi-step desulfurization process. Specifically, the process involves a hydrodesulfurization step, an oxidizing step, a decomposition step, and a separation step wherein a portion of the sulfur-oxidated compounds are separated from the effluent stream of the decomposition step. The aqueous oxidizing solution used in the oxidizing step preferably contains acetic acid and hydrogen peroxide. Any residual hydrogen peroxide in the oxidizing step effluent is decomposed by contacting the effluent with a decomposition catalyst.

The separation step is carried out with a selective solvent to extract the sulfur-oxidated compounds. Per the teachings of Cabrera et al. the preferred selective solvents are acetonitrile, dimethyl formamide, and sulfolane.

A number of solvents have been proposed for removing the oxidized sulfur compounds. For example, in U.S. Pat. No. 6,160,193 (Gore) teaches the use of a wide variety of solvents suitable for use in the extraction of sulfones. The preferred solvent is Dimethylsulfoxide (DMSO).

A study of a similar list of solvents used in the extraction of sulfur compounds was published by Otsuki, S.; Nonaka, T.; Takashima, N.; Qian, W.; Ishihara, A.; Imai, T.; Kabe, T. "Oxidative Desulfurization of Light Gas Oil and Vacuum Gas Oil by Oxidation and Solvent Extraction" *Energy & Fuels* 2000, 14, 1232. That list is displayed below:

N,N-Dimethylformamide (DMF)
Methanol
Acetonitrile
Sulfolane

Gore states that there is a relationship between the solvent's polarity with the solvent's extraction efficiency. All of the solvents listed in the patent and the paper are desirably immiscible with the diesel. They are all characterized as either polar protic or aprotic solvents.

There are several deleterious effects arising from the use of the above-mentioned solvents. While DMSO and sulfolane are good solvents for extractions, there is a tremendous risk that any traces of these solvents left in the product could dramatically increase the sulfur concentration in the diesel product. For example, even residual DMSO in the final product at a concentration of 37 ppmw would impart a sulfur concentration the final diesel fuel of 15 ppmw. Similar detrimental effects can result from the use of acetonitrile, triethanolamine, and DMF which contain nitrogen atoms. Trace levels of these solvents would dramatically increase the nitrogen concentration in the final product.

The above solvents are not particularly selective for sulfur, as they will also remove aromatics, particularly monoaromatics since these species are likely to be the most polar components of a diesel fuel. On the surface, it would appear to be beneficial to enrich the diesel fuel with saturates (paraffins) by removing these aromatics, which achieves a higher cetane number in the fuel. The downside is that the extracting solvent's stream size would swell dramatically and would contain these monoaromatics of some value which must be recovered. For example, it is known from the above cited article that DMF can extract unoxidized dibenzothiophenes, but it also removes a substantial portion of the oil. A significant effort would be needed to recover the hydrocarbon and not co-recover the dibenzothiophenes.

Another concern with the use of the above solvents is the boiling point. A higher boiling point would make it difficult to separate traces of the solvent from the final product by a flash. A flash here would result in taking some of the lower boiling diesel components with it. For example, DMSO has a boiling point of 189° C. or 372° F., and DMF has a boiling point of 153° C. or 307° F. The initial boiling point of a diesel fuel is typically below the boiling points of these two solvents.

Toxicity is another issue. While DMSO is technically a low toxicity solvent, it is classified as a "super-solvent" which can dissolve a wide variety of compounds. Skin contact of this DMSO solution will rapidly cause the solute to be adsorbed through the skin, which is one of the characteristics of DMSO. DMF is a liver toxin and a suspected carcinogen. Acetonitrile is also quite toxic.

DMF is not thermally stable enough to be distilled under atmospheric pressure. At the ambient pressure boiling point of DMF, degradation also occurs to give carbon monoxide and dimethyl amine (Perrin, D. D.; Armarego, W. L F. *Purification of Laboratory Chemicals,* 3rd Edition, Pergamon Press, Oxford, 1988, page 157). Vacuum distillation is therefore required.

Gore in the '193 patent points out the shortcomings associated with methanol, i.e. the methanol has about the same density as the typical hydrocarbon fuel. Based on a process of elimination, methanol appears to be a good solvent in terms of its boiling properties, and the fact that it will not leave behind nitrogen or sulfur. However, a significant fraction of the total hydrocarbon will also be extracted into the methanol layer. Methanol is also disadvantaged by the fact that it does not rapidly separate from the diesel.

In view of the above, it is clear that there is a need for a less complex, economic distillate or diesel desulfurization process that does not employ the use of toxic solvents such as acetonitrite or DMF, super-solvents such as DMSO or hard to separate solvents such as DMF.

The present invention provides for a relatively simple process wherein a portion of the oxidized sulfur containing and/or nitrogen-containing organic compounds contained in a hydrocarbon feedstock are extracted simultaneously during an oxidation process step and subsequently separated via a decantation or phase separation step. This phase separation results in less sulfur and nitrogen species to be removed further downstream via an extraction step. Further, the process of the present invention provides for the use of a single solvent, acetic acid for both the oxidation step, and an extraction step; thereby permitting the use of only one regenerator tower to regenerate the acetic acid for both the oxidation step and the extraction step. In a specific embodiment of the present invention, the invention provides for the use of a reduced amount of expensive oxidizing agent in the oxidation step.

SUMMARY OF THE INVENTION

A process is disclosed for the production of refinery transportation fuel or components for refinery blending of transportation fuels wherein the product components contain a reduced amount of sulfur and/or nitrogen-containing organic impurities. More particularly, the process of the invention involves contacting a hydrocarbon feedstock containing sulfur and/or nitrogen containing organic impurities with an immiscible phase comprising an oxidizing agent comprising hydrogen peroxide, acetic acid, and water in an oxidation zone whereby the sulfur and/or nitrogen-containing organic impurities are oxidized and a portion of such oxidized impurities are extracted into the immiscible phase. Subsequent to the oxidation an immiscible phase containing a portion of the oxidized sulfur and/or nitrogen compounds is separated via gravity separation in order to produce a first hydrocarbon stream having a reduced content of sulfur and/or nitrogen-containing compounds.

The first hydrocarbon stream is then passed to a liquid-liquid extraction zone wherein the extracting solvent comprises acetic acid and water, which serves to preferentially extract a portion of any additional remaining oxidized sulfur and/or nitrogen compounds from the first hydrocarbon stream and thereby produce a second hydrocarbon stream having a reduced content of oxidized sulfur and/or nitrogen-containing compounds. The extract stream containing the oxidized sulfur and/or nitrogen organic compounds together with the immiscible phase containing oxidized sulfur and/or nitrogen containing organic compounds separated from the first hydrocarbon stream are then passed to a separation zone whereby the oxidated sulfur and/or nitrogen compounds are separated from the acetic acid and water which can then be recycled to the oxidation zone and the liquid-liquid extraction zone.

DETAILED DESCRIPTION OF THE INVENTION

Figure 1:
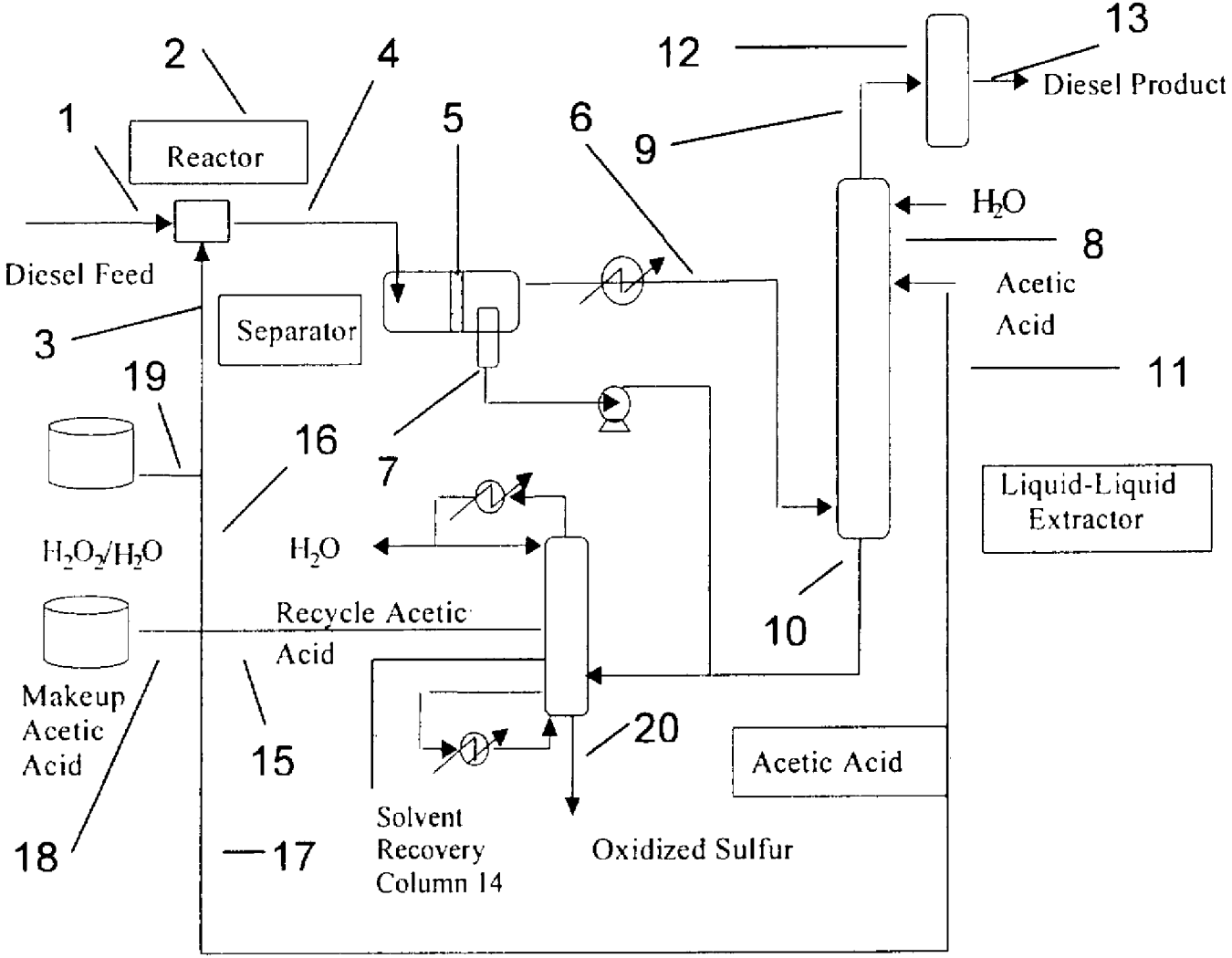
FIG. 1 is a schematic drawing of one embodiment of the process of the invention.

Suitable feedstocks generally comprise most refinery streams consisting substantially of hydrocarbon compounds which are liquid at ambient conditions. A suitable hydrocarbon feedstock generally has an API gravity ranging from about 10° API to about 100° API, preferably from about 20° API to about 80 or 100° API, and more preferably from about 30° API to about 70° or 100° API for best results. These streams include, but are not limited to, fluid catalytic process naphtha, fluid or delayed process naphtha, light virgin naphtha, hydrocracker naphtha, hydrotreating process naphthas, alkylate, isomerate, catalytic reformate, and aromatic derivatives of these streams such benzene, toluene, xylene, and combinations thereof. Catalytic reformate and catalytic cracking process naphthas can often be split into narrower boiling range streams such as light and heavy catalytic naphthas and light and heavy catalytic reformate, which can be specifically customized for use as a feedstock in accordance with the present invention. The preferred streams are light virgin naphtha, catalytic cracking naphthas including light and heavy catalytic cracking unit naphtha, catalytic reformate including light and heavy catalytic reformate and derivatives of such refinery hydrocarbon streams.

Suitable feedstocks generally include refinery distillate streams boiling at a temperature range from about 50° C. to about 425° C., preferably 150° C. to about 400° C., and more preferably between about 175° C. and about 375° C. at atmospheric pressure for best results. These streams include, but are not limited to, virgin light middle distillate, virgin heavy middle distillate, fluid catalytic cracking process light catalytic cycle oil, coker still distillate, hydrocracker distillate, and the collective and individually hydrotreated embodiments of these streams. The preferred streams are the collective and individually hydrotreated embodiments of fluid catalytic cracking process light catalytic cycle oil, coker still distillate, and hydrocracker distillate.

It is also anticipated that one or more of the above distillate streams can be combined for use as feedstock to the process of the invention. In many cases performance of the refinery transportation fuel or blending components for refinery transportation fuel obtained from the various alternative feedstocks may be comparable. In these cases, logistics such as the volume availability of a stream, location of the nearest connection and short-term economics may be determinative as to what stream is utilized.

In one aspect, this invention provides for the production of refinery transportation fuel or blending components for refinery transportation fuel from a hydrotreated petroleum distillate. Such a hydrotreated distillate is prepared by hydrotreating a petroleum distillate material boiling between about 50° C. and about 425° C. by a process which includes reacting the petroleum distillate with a source of hydrogen at hydrogenation conditions in the presence of a hydrogenation catalyst to assist by hydrogenation removal of sulfur and/or nitrogen from the hydrotreated petroleum distillate; optionally fractionating the hydrotreated petroleum distillate by distillation to provide at least one low-boiling blending component consisting of a sulfur-lean, mono-aromatic-rich fraction, and a high-boiling feedstock consisting of a sulfur-rich, mono-aromatic-lean fraction. In accordance with one embodiment of the process of the present invention the hydrotreated distillate or the low-boiling component can be used as suitable feedstocks for the process of the present invention.

Generally, useful hydrogenation catalysts comprise at least one active metal, selected from the group consisting of the d-transition elements in the Periodic Table, each incorporated onto an inert support in an amount of from about 0.1 percent to about 30 percent by weight of the total catalyst. Suitable active metals include the d-transition elements in the Periodic Table elements having atomic number in from 21 to 30, 39 to 48, and 72 to 78.

The catalytic hydrogenation process may be carried out under relatively mild conditions in a fixed, moving fluidized or ebullient bed of catalyst. Preferably a fixed bed or plurality of fixed beds of catalyst is used under conditions such that relatively long periods elapse before regeneration becomes necessary. Average reaction zone temperatures can range from about 200° C. to about 450° C., preferably from about 250° C. to about 400° C., and most preferably from about 275° C. to about 350° C. for best results, and at a pressures can range of from about 6 to about 160 atmospheres.

A particularly preferred pressure range within which the hydrogenation provides extremely good sulfur removal while minimizing the amount of pressure and hydrogen required for the hydrodesulfurization step are pressures within the range of 20 to 60 atmospheres, more preferably from about 25 to 40 atmospheres.

Hydrogen circulation rates generally range from about 500 SCF/Bbl to about 20,000 SCF/Bbl, preferably from about 2,000 SCF/Bbl to about 15,000 SCF/Bbl, and most preferably from about 3,000 to about 13,000 SCF/Bbl for best results. Reaction pressures and hydrogen circulation rates below these ranges can result in higher catalyst deactivation rates resulting in less effective desulfurization, denitrogenation, and dearomatization. Excessively high reaction pressures increase energy and equipment costs and provide diminishing marginal benefits.

The hydrogenation process typically operates at a liquid hourly space velocity of from about 0.2 hr−1 to about 10.0 $hr^{-1}$, preferably from about 0.5 $hr^{-1}$ to about 3.0 $hr^{-1}$, and most preferably from about 1.0 $hr^{-1}$ to about 2.0 $hr^{-1}$ for best results. Excessively high space velocities will result in reduced overall hydrogenation.

Generally, the hydrogenation process useful in the present invention begins with a distillate fraction preheating step. The distillate fraction is preheated in feed/effluent heat exchangers prior to entering a furnace for final preheating to a targeted reaction zone inlet temperature. The distillate fraction can be contacted with a hydrogen stream prior to, during, and/or after preheating.

The hydrogen stream can be pure hydrogen or can be in admixture with diluents such as hydrocarbon, carbon monoxide, carbon dioxide, nitrogen, water, sulfur compounds, and the like. The hydrogen stream purity should be at least about 50 percent by volume hydrogen, preferably at least about 65 percent by volume hydrogen, and more preferably at least about 75 percent by volume hydrogen for best results. Hydrogen can be supplied from a hydrogen plant, a catalytic reforming facility or other hydrogen producing process.

Since the hydrogenation reaction is generally exothermic, interstage cooling, consisting of heat transfer devices between fixed bed reactors or between catalyst beds in the same reactor shell, can be employed. At least a portion of the heat generated from the hydrogenation process can often be profitably recovered for use in the hydrogenation process. Where this heat recovery option is not available, cooling may be performed through cooling utilities such as cooling water or air, or through use of a hydrogen quench stream injected directly into the reactors. Two-stage processes can provide reduced temperature exotherm per reactor shell and provide better hydrogenation reactor temperature control.

The reaction zone effluent is generally cooled and the effluent stream is directed to a separator device to remove the hydrogen. Some of the recovered hydrogen can be recycled back to the process while some of the hydrogen can be purged to external systems such as plant or refinery fuel. The hydrogen purge rate is often controlled to maintain a minimum hydrogen purity and remove hydrogen sulfide. Recycled hydrogen is generally compressed, supplemented with "make-up" hydrogen, and injected into the process for further hydrogenation.

Further reduction of such heteroaromatic sulfides from a distillate petroleum fraction by hydrotreating would require that the stream be subjected to very severe catalytic hydrogenation in order to convert these compounds into hydrocarbons and hydrogen sulfide ($H_2S$). Typically, the larger any hydrocarbon moiety is, the more difficult it is to hydrogenate the sulfide. Therefore, the residual organo-sulfur compounds remaining after a hydrotreatment are the most tightly substituted sulfides.

Where the feedstock is a high-boiling distillate fraction derived from hydrogenation of a refinery stream, the refinery stream consists essentially of material boiling between about 200° C. and about 425° C. Preferably the refinery stream consisting essentially of material boiling between about 250° C. and about 400° C., and more preferably boiling between about 275° C. and about 375° C.

Useful distillate fractions for hydrogenation in the present invention consists essentially of any one, several, or all refinery streams boiling in a range from about 50° C. to about 425° C., preferably 150° C. to about 400° C., and more preferably between about 175° C. and about 375° C. at atmospheric pressure. The lighter hydrocarbon components in the distillate product are generally more profitably recovered to gasoline and the presence of these lower boiling materials in distillate fuels is often constrained by distillate fuel flash point specifications. Heavier hydrocarbon components boiling above 400° C. are generally more profitably processed as fluid catalytic cracker feed and converted to gasoline. The presence of heavy hydrocarbon components in distillate fuels is further constrained by distillate fuel end point specifications.

The distillate fractions for hydrogenation in the present invention can comprise high and low sulfur virgin distillates derived from high- and low-sulfur crudes, coker distillates, catalytic cracker light and heavy catalytic cycle oils, and distillate boiling range products from hydrocracker and resid hydrotreater facilities. Generally, coker distillate and the light and heavy catalytic cycle oils are the most highly aromatic feedstock components, ranging as high as 80 percent by weight. The majority of coker distillate and cycle oil aromatics are present as mono-aromatics and di-aromatics with a smaller portion present as tri-aromatics. Virgin stocks such as high and low sulfur virgin distillates are lower in aromatics content ranging as high as 20 percent by weight aromatics. Generally, the aromatics content of a combined hydrogenation facility feedstock will range from about 5 percent by weight to about 80 percent by weight, more typically from about 10 percent by weight to about 70 percent by weight, and most typically from about 20 percent by weight to about 60 percent by weight.

Sulfur concentration in distillate fractions for hydrogenation in the present invention is generally a function of the high and low sulfur crude mix, the hydrogenation capacity of a refinery per barrel of crude capacity, and the alternative dispositions of distillate hydrogenation feedstock components. The higher sulfur distillate feedstock components are generally virgin distillates derived from high sulfur crude, coker distillates, and catalytic cycle oils from fluid catalytic cracking units processing relatively higher sulfur feedstocks. These distillate feedstock components can range as high as 2 percent by weight elemental sulfur but generally range from about 0.1 percent by weight to about 0.9 percent by weight elemental sulfur.

Nitrogen content of distillate fractions for hydrogenation in the present invention is also generally a function of the nitrogen content of the crude oil, the hydrogenation capacity of a refinery per barrel of crude capacity, and the alternative dispositions of distillate hydrogenation feedstock components. The higher nitrogen distillate feedstocks are generally coker distillate and the catalytic cycle oils. These distillate feedstock components can have total nitrogen concentrations ranging as high as 2000 ppm, but generally range from about 5 ppm to about 900 ppm.

Typically, sulfur compounds in petroleum fractions are relatively non-polar, heteroaromatic sulfides such as substituted benzothiophenes and dibenzothiophenes. At first blush it might appear that heteroaromatic sulfur compounds could be selectively extracted based on some characteristic attributed only to these heteroaromatics. Even though the sulfur atom in these compounds has two, non-bonding pairs of electrons which would classify them as a Lewis base, this characteristic is still not sufficient for them to be extracted by a Lewis acid. In other words, selective extraction of heteroaromatic sulfur compounds to achieve lower levels of sulfur requires greater difference in polarity between the sulfides and the hydrocarbons.

By means of liquid phase oxidation according to this invention it is possible to selectively convert these sulfides into, more polar, Lewis basic, oxygenated sulfur compounds such as sulfoxides and sulfones. A compound such as dimethylsulfide is a very non-polar molecule, whereas when oxidized, the molecule is very polar. Accordingly, by selectively oxidizing heteroaromatic sulfides such as benzo- and dibenzothiophene found in a refinery streams, processes of the invention are able to selectively bring about a higher polarity characteristic to these heteroaromatic compounds. Where the polarity of these unwanted sulfur compounds is increased by means of liquid phase oxidation according to this invention, they can be selectively extracted by an acetic acid containing solvent while the bulk of the hydrocarbon stream is unaffected.

Other compounds which also have non-bonding pairs of electrons include amines. Heteroaromatic amines are also found in the same stream that the above sulfides are found. Amines are more basic than sulfides. The lone pair of electrons functions as a Bronsted—Lowry base (proton acceptor) as well as a Lewis base (electron-donor). This pair of electrons on the atom makes it vulnerable to oxidation in manners similar to sulfides.

In one aspect, this invention provides a process for the production of refinery transportation fuel or blending components for refinery transportation fuel, which includes: providing hydrocarbon feedstock comprising a mixture of hydrocarbons, sulfur-containing and nitrogen-containing organic compounds, the mixture having a gravity ranging from about 10° API to about 100° API; contacting the feedstock with an immiscible phase comprising acetic acid, water and an oxidation agent comprising hydrogen peroxide in a liquid phase reaction mixture in an oxidation zone under conditions suitable for the oxidation of one or more of the sulfur-containing and/or nitrogen-containing organic compounds; separating at least a portion of the immiscible acetic acid-containing phase from the reaction mixture; and recovering a first hydrocarbon stream comprising a mixture of organic compounds containing less sulfur and/or less nitrogen than in the feedstock to the oxidation reaction zone. Conditions of oxidation include temperatures in a range upward from about 25° C. to about 250° C. and sufficient pressure to maintain the reaction mixture substantially in a liquid phase. Preferably the oxidation conditions include an oxidation temperature of less than about 90° C. and greater than about 25° C. and most preferably greater than about 50° C. and less than about 90° C.

It is known, from Lin, C. C.; Smith, T. R.; Ichikawa, N.; Baba, T; Itow, M. International Journal of Chemical Kinetics, 1991 Vol. 23, pp. 971 to 987, that temperatures higher than 90° C. tend to result in an undesirable thermal decomposition of hydrogen peroxide resulting in a higher usage rate.

The first hydrocarbon stream is then contacted with a solvent comprising acetic acid in a liquid-liquid extraction zone to produce an extract stream containing at least a portion of the oxidized sulfur-containing and/or nitrogen-containing organic compounds remaining in the first hydrocarbon stream and a second hydrocarbon stream containing a reduced amount of oxidized sulfur-containing and/or nitrogen-containing organic compounds. The second hydrocarbon stream is then optionally recovered as a transportation fuel or a blending component for blending transportation fuels or contacted with water in a second liquid-liquid extraction zone to remove any undesirable amount of acetic acid present in the second hydrocarbon stream. A third hydrocarbon stream suitable for use as a transportation fuel or blending component for blending transportation fuels having a reduced amount of acetic acid, sulfur and nitrogen is then recovered from the second extraction zone.

Generally, for use in this invention, the immiscible phase used in the oxidation step is formed by admixing a source of hydrogen peroxide, acetic acid, and water.

Hydrogen peroxide is added in an amount such that the stoichiometric molar ratio of hydrogen peroxide to sulfur and nitrogen ranges from about 1:1 to about 3:1. This stoichiometry is determined assuming that the hydrogen peroxide to sulfide and hydrogen peroxide to nitrogen stoichiometries are 2:1 and 1:1, respectively. While increasing the stoichiometric ratios can achieve very high sulfur reduction, such high ratios also significantly increase the variable costs inasmuch as hydrogen peroxide is an expensive industrial chemical.

In another embodiment of this invention the immiscible phase will contain an amount of protic acid not containing sulfur or nitrogen ranging preferably from about 0.5 wt. % to about 10 wt. % of the immiscible phase, and most preferably from about 1 wt. % to about 3 wt. %. The presence of the acid catalyst serves to improve the desulfurization taking place in the oxidation zone. The preferred protic acid is phosphoric acid. The use of sulfur-containing or nitrogen-containing acids such as sulfuric acid or nitric acid is not recommended in carrying out the process of the invention inasmuch as these acids have the potential of adding sulfur and nitrogen to final fuel recovered product or blending component. The use of the protic acid permits a reduction in the amount of hydrogen peroxide usage. In accordance with this embodiment of the invention hydrogen peroxide is used in a stoichiometric molar ratio of hydrogen peroxide to sulfur and nitrogen of about 1 to 1 to about 3 to 1 and most preferably about 1 to 1 to about 2 to 1 where a protic acid is used.

Advantageously, the immiscible phase is an aqueous liquid formed by admixing, water, a source of acetic acid, and a source of hydrogen peroxide in amounts such that the amount of acetic acid present ranges from about 80 wt. % to about 99 wt. % and more preferably from about 95 wt. % to about 99 wt. % based on the total weight of the immiscible phase.

The reaction is carried out for a sufficient time to effect the desirable degree desulfurization and denitrogenation. Preferably the residence time of the reactants in the oxidation zone ranges from about 5 to about 180 minutes.

Applicants believe the oxidation reaction involves rapid reaction of organic peracid with the divalent sulfur atom by a concerted, non-radical mechanism whereby an oxygen atom is actually donated to the sulfur atom. As stated previously, in the presence of more peracid, the sulfoxide is further converted to the sulfone, presumably by the same mechanism. Similarly, it is expected that the nitrogen atom of an amine is oxidized in the same manner by hydroperoxy compounds.

The statement that oxidation according to the invention in the liquid reaction mixture comprises a step whereby an oxygen atom is donated to the divalent sulfur atom is not to be taken to imply that processes according to the invention actually proceeds via such a reaction mechanism.

For the purpose of the present invention, the term "oxidation" is defined as any means by which one or more sulfur-containing organic compound and/or nitrogen-containing organic compound is oxidized, e.g., the sulfur atom of a sulfur-containing organic molecule is oxidized to a sulfoxide and/or sulfone.

By contacting the feedstock with the immiscible phase in accordance with the present invention, the tightly substituted sulfides are oxidized into their corresponding sulfoxides and sulfones with negligible if any co-oxidation of mononuclear aromatics. The high selectivity of the oxidants, coupled with the small amount of tightly substituted sulfides in hydrotreated streams, makes the instant invention a particularly effective deep desulfurization means with minimum yield loss. The yield loss generally corresponds to the amount of tightly substituted sulfides oxidized. Since the amount of tightly substituted sulfides present in a hydrotreated crude is rather small, the yield loss is correspondingly small. Further during the biphasic oxidation step, a portion of the oxidated sulfur- and nitrogen-containing compounds are simultaneously extracted into the immiscible phase containing the hydrogen peroxide, acetic acid and water.

The oxidation zone reaction can be carried out in batch mode or continuous mode. Those skilled in the art may employ a stirred tank reactor, for the batch operation or a continuously stirred tank reactor ("CSTR") for the continuous mode operation. In the CSTR reactor the residence time range pertains to the average residence time of the reactants in the reactor.

Subsequent to the oxidation step or the oxidation step, the two immiscible phases are separated in a mixer-settler or similar decanting unit operation utilizing gravity separation of the phases. Specifically, the organic phase, the first hydrocarbon stream, will desirably contain a reduced sulfur content ranging from 10 to 70% based on the sulfur in the feedstock. The first hydrocarbon stream, the lighter phase, is then passed to a liquid-liquid extraction zone.

The liquid-liquid extraction is carried out with solvent containing acetic acid and water. It has been found that when the solvent contains less water, the sulfur removal efficiency is increased; however, this can result in an over extraction of the first hydrocarbon stream. Preferably in order to prevent overextraction yet permit the extraction of desirable amount of sulfur and/or nitrogen containing compounds, the solvent in accordance with the present invention should contain about 70 to about 92 wt. %, preferably about 85 to about 92 wt. % acetic acid with the balance being water. The solvent preferentially extracts oxidated sulfur-containing and/or nitrogen containing compounds from the first hydrocarbon stream resulting in a second hydrocarbon stream containing less oxidated sulfur and/or nitrogen-containing organic compounds. The liquid-liquid extraction can be carried out in any manner known to those skilled in the art including utilizing counter-current extraction cross-current or co-current flow. The preferred operating temperature range ranges from 25 to 200° C. while the preferred pressure ranges from 0 to 300 psig. This second hydrocarbon stream containing less than 50 ppm S and less than 50 ppm N and preferably less than 20 ppm S and less than 20 ppm N, can then be recovered as a fuel or fuel blending component.

To the extent solvent remains in the product or second hydrocarbon stream, a second water liquid-liquid extraction step can subsequently be carried out.

The second water extraction step involves contacting the second hydrocarbon stream with water in order to extract the desirable amount of acetic acid remaining in the second hydrocarbon stream.

A third hydrocarbon stream having a reduced amount of acetic acid is then recovered as a fuel or fuel blending component. The preferred operating temperature range for this second liquid-liquid extraction ranges from 25 to 100° C. while the preferred pressure ranges from 0 to 300 psig.

A substantial benefit of the present invention arises from the use of acetic acid in both the oxidation zone and the extraction zone.

In a preferred embodiment, this permits one practicing the invention to pass both the immiscible phase separated subsequent to the oxidation step and the acetic acid extract stream from the acetic acid solvent liquid-liquid extraction step to a common separation unit such as a distillation column wherein the acetic acid and any excess water are separated from the higher boiling sulfur-containing and/or nitrogen containing organic compounds. The recovered acetic acid can then be recycled to the oxidation zone and liquid-liquid extraction zone. Specifically, a portion of the recovered acetic acid can then passed back to the oxidation zone or optionally to a make-up tank. Hydrogen peroxide, water, and optionally protic acid are added prior to recycle to the oxidation zone such that the oxidation zone can be operated in accordance with the present invention. Further, another portion of the acetic acid can be recycled to the first liquid-liquid extraction with the water content adjusted prior to recycle to the oxidation zone in accordance with the present invention.

For a more complete understanding of the present invention, reference should now be made to the embodiments illustrated in greater detail in the accompanying figures and described below by way of examples of the invention.

DETAILED DESCRIPTION OF FIG. 1

An embodiment of the present invention is shown schematically in FIG. 1.

Diesel feed (1) containing sulfur-containing and/or nitrogen containing organic impurities is passed to the oxidation zone Reactor (2). A stream containing acetic acid, hydrogen peroxide and water is introduced to the oxidation zone reactor via conduit (3). The reaction mixture is passed to separator/settler (5) via conduit (4). Separator (5) serves to separate a first intermediate hydrocarbon stream having a reduced content of sulfur and/or nitrogen-containing organic impurities. Conduit (7) is used to remove the immiscible aqueous acetic acid phase containing oxidized sulfur and/or nitrogen compounds.

The first intermediate hydrocarbon stream is removed from the separator via conduit (6) and is contacted with aqueous acetic acid in liquid-liquid extraction zone (8). The acetic acid entering the liquid-liquid extractor via conduit 11 serves to extract residual oxidized sulfur and/or nitrogen compounds from the first intermediate hydrocarbon stream. The second intermediate hydrocarbon stream having a reduced amount of oxidized sulfur and/or nitrogen is then removed from the extraction zone via conduit (9) and passed to a water wash zone (12) wherein any residual acetic acid is removed and a product is recovered in conduit (13).

Conduit (10) serves to pass the extract stream from the extraction zone to solvent recovery column (14) wherein oxidized sulfur and/or nitrogen compounds are separated from the aqueous acetic acid. Conduit (7) serves to pass the aqueous acetic acid stream from the separator/settler to the solvent recovery column as well. Conduit (15) passes the recycled acetic acid to the oxidation zone and liquid-liquid extraction zone via conduits (16) and (17), respectively. Conduit (19) is used to pass fresh hydrogen peroxide and water to the oxidation zone while conduit (18) is used to pass fresh make-up acetic acid to the process.

EXAMPLE 1

TABLE I

| Physical Properties of Diesel Feed | |
|---|---|
| Elemental Analyses | |
| Carbon (wt %) | 86.84 |
| Hydrogen (wt %) | 12.54 |
| Oxygen (wt %) | 0.15 |
| Sulfur (ppm) | 345 |
| Nitrogen (ppm) | 112 |
| API Gravity | 32.50 |
| Specific Gravity | 0.8628 |
| Heat of Combustion (BTU/lb) | 19424 |
| Hydrocarbon Type (wt %) | |
| Saturates | 61.0 |
| Monoaromatics | 33.7 |
| Diaromatics | 5.1 |
| Triaromatics | 0.2 |

TABLE I-continued

| Physical Properties of Diesel Feed | |
|---|---|
| D86 Distillation (%) | ° F. |
| IBP | 339.3 |
| 5.0 | 393.3 |
| 10.0 | 412.5 |
| 20.0 | 438.2 |
| 30.0 | 461.7 |
| 40.0 | 482.6 |
| 50.0 | 501.2 |
| 60.0 | 522.5 |
| 70.0 | 544.6 |
| 80.0 | 570.5 |
| 90.0 | 608.9 |
| 95.0 | 645.8 |
| FBP | 658.5 |

Several batch experiments were carried out demonstrating the process of the present invention. The diesel feed had the composition set forth in Table I.

Hydrogen peroxide, acetic acid, water, and diesel fuel loadings were held constant in all of these experiments. A reactor consisting of a round-bottom flask, an overhead agitator, reflux condenser, a nitrogen inlet and outlet, a heating mantel, was charged with 300 g of diesel fuel (345 ppm S, 112 ppm N), 300 g of glacial acetic acid, 1.01 g 30% aqueous hydrogen peroxide, and 25.5 g of distilled and dionized ("D&D") water. The reaction mixture was agitated vigorously and heating was initiated. Nitrogen was fed through an inlet to sweep the surface of the mixture to prevent a buildup of oxygen from any peroxide decomposition. Once the reaction temperature had reached the targeted level, the mixture was stirred at that temperature for a predetermined reaction time. After the oxidation period had elapsed, the diesel product was cooled and decanted, and sampled for S and N analyses. The diesel layer was then extracted with three portions of 85% aqueous acetic acid (2:1 diesel/solvent, ratio). The diesel layer following these extractions was then subjected to three extractions with water (in accordance with a 1:1 diesel/water weight ratio). The diesel product was then submitted for S and N analyses.

The reaction conditions, desulfurization, denitrogenation, and material balance results are summarized in Tables II through V. The desulfurization and denitrogenation results are listed separately for post-oxidation and post-extraction. The former gives the results of desulfurization and denitrogenation after the oxidation stage, and the latter gives the results after the liquid-liquid extraction stage.

TABLE II

| Oxidation at 50° C. at 60 Minutes | | | | | | | |
|---|---|---|---|---|---|---|---|
| | Run | | | | | | |
| | 1 | 2 | 3 | 4 | 5 | 6 | 7 |
| Acid Catalyst | None | Formic | | | Phosphoric | | |
| Acid Catalyst Loading (wt %) | 0.00 | 1.0 | 2.5 | 5.0 | 1.0 | 2.5 | 5.0 |
| Reductions from Feed (%) | | | | | | | |
| Post-Oxidation Sulfur | 25.2 | 43.5 | 40.3 | 48.4 | 39.4 | 46.1 | 45.5 |
| Post-Extraction Sulfur | 24.6 | 46.7 | 45.2 | 51.6 | 41.2 | 48.4 | 50.1 |

TABLE II-continued

| Oxidation at 50° C. at 60 Minutes | Run | | | | | | |
|---|---|---|---|---|---|---|---|
| | 1 | 2 | 3 | 4 | 5 | 6 | 7 |
| Post-Oxidation Nitrogen | 53.6 | 56.3 | 57.1 | 58.0 | 52.7 | 50.0 | 48.2 |
| Post-Extraction Nitrogen | 76.8 | 78.6 | 78.6 | 78.6 | 75.9 | 75.0 | 76.8 |
| Balances (%) | | | | | | | |
| Post-Oxidation Diesel | 107.2 | 105.7 | 105.9 | 105.8 | 106.9 | 105.8 | 106.7 |
| Post-Oxidation Aqueous HOAc | 82.7 | 86.1 | 81.8 | 82.2 | 78.3 | 82.2 | 83.8 |
| 1st 85% HOAc Extraction | 108.7 | 108.4 | 107.3 | 107.2 | 109.1 | 104.0 | 106.8 |
| 2nd 85% HOAc Extraction | 102.2 | 102.2 | 103.0 | 103.0 | 102.0 | 102.8 | 102.6 |
| 3rd 85% HOAc Extraction | 117.0 | 102.0 | 101.0 | 100.2 | 100.2 | 101.1 | 98.6 |
| 1st Water Extraction | 105.9 | 106.3 | 105.6 | 104.5 | 105.3 | 105.6 | 105.6 |
| 2nd Water Extraction | 100.1 | 99.4 | 100.0 | 99.8 | 100.0 | 100.8 | 99.9 |
| 3rd Water Extraction | 100.3 | 100.3 | 100.6 | 100.4 | 100.8 | 99.7 | 100.3 |
| Diesel After Extractions | 85.1 | 83.6 | 93.4 | 83.8 | 82.6 | 84.6 | 83.3 |

TABLE III

| Oxidation at 50° C. at 120 Minutes | Run | | | | | | |
|---|---|---|---|---|---|---|---|
| | 8 | 9 | 10 | 11 | 12 | 13 | 14 |
| Acid Catalyst | None | Formic | | | Phosphoric | | |
| Acid Catalyst Loading (wt %) | 0.00 | 1.0 | 2.5 | 5.0 | 1.0 | 2.5 | 5.0 |
| Reductions from Feed (%) | | | | | | | |
| Post-Oxidation Sulfur | 29.6 | 42.3 | 46.1 | 52.8 | 38.6 | 41.2 | 55.4 |
| Post-Extraction Sulfur | 42.0 | 44.6 | 48.7 | 55.7 | 42.6 | 42.0 | 62.0 |
| Post-Oxidation Nitrogen | 25.9 | 56.3 | 57.1 | 55.4 | 53.6 | 52.7 | 48.2 |
| Post-Extraction Nitrogen | 59.8 | 76.8 | 78.6 | 77.7 | 76.8 | 76.8 | 72.3 |
| Balances (%) | | | | | | | |
| Post-Oxidation Diesel | 106.7 | 106.2 | 105.9 | 105.3 | 108.2 | 105.2 | 106.3 |
| Post-Oxidation Aqueous HOAc | 73.7 | 82.2 | 81.0 | 74.6 | 81.4 | 81.5 | 80.3 |
| 1st 85% HOAc Extraction | 108.7 | 108.7 | 109.3 | 107.9 | 105.0 | 106.9 | 105.7 |
| 2nd 85% HOAc Extraction | 102.2 | 103.0 | 102.8 | 102.4 | 103.8 | 102.0 | 103.0 |
| 3rd 85% HOAc Extraction | 101.6 | 102.4 | 102.4 | 102.2 | 99.8 | 101.6 | 101.0 |
| 1st Water Extraction | 104.9 | 105.1 | 104.9 | 105.4 | 105.1 | 105.1 | 105.3 |
| 2nd Water Extraction | 100.3 | 97.3 | 100.7 | 99.9 | 100.3 | 100.4 | 100.5 |
| 3rd Water Extraction | 0.00 | 100.7 | 100.0 | 96.8 | 100.0 | 100.1 | 99.7 |
| Diesel After Extractions | N/A | 83.1 | 83.1 | 84.0 | 85.4 | 84.3 | 84.7 |

TABLE IV

| Oxidation at 80° C. at 60 Minutes | Run | | | | | | |
|---|---|---|---|---|---|---|---|
| | 15 | 16 | 17 | 1 | 19 | 20 | 21 |
| Acid Catalyst | None | Formic | | | Phosphoric | | |
| Acid Catalyst Loading (wt %) | 0.00 | 1.0 | 2.5 | 5.0 | 1.0 | 2.5 | 5.0 |
| Reductions from Feed (%) | | | | | | | |
| Post-Oxidation Sulfur | 41.7 | 56.5 | 58.6 | 62.3 | 51.3 | 56.8 | 52.2 |
| Post-Extraction Sulfur | 42.0 | 63.8 | 62.9 | 66.4 | 67.5 | 66.4 | 71.3 |
| Post-Oxidation Nitrogen | 22.3 | 51.8 | 55.4 | 57.1 | 46.4 | 57.1 | 55.4 |
| Post-Extraction Nitrogen | 59.8 | 75.9 | 76.8 | 76.8 | 75.0 | 77.7 | 75.9 |
| Balances (%) | | | | | | | |
| Post-Oxidation Diesel | 106.5 | 105.4 | 105.5 | 104.3 | 104.4 | 105.3 | 106.4 |
| Post-Oxidation Aqueous HOAc | 74.4 | 62.1 | 77.2 | 78.5 | 73.8 | 77.1 | 77.62 |
| 1st 85% HOAc Extraction | 111.1 | 110.9 | 110.3 | 107.4 | 107.9 | 107.3 | 107.1 |
| 2nd 85% HOAc Extraction | 103.0 | 102.8 | 102.6 | 102.2 | 101.2 | 102.8 | 103.2 |
| 3rd 85% HOAc Extraction | 102.2 | 101.8 | 102.0 | 101.4 | 100.8 | 101.4 | 101.2 |
| 1st Water Extraction | 104.9 | 105.1 | 104.7 | 105.1 | 105.5 | 105.5 | 105.7 |
| 2nd Water Extraction | 99.6 | 99.9 | 100.0 | 99.8 | 100.1 | 99.7 | 100.5 |
| 3rd Water Extraction | 100.8 | 101.3 | 100.3 | 99.9 | 100.4 | 100.2 | 100.2 |
| Diesel After Extractions | 82.6 | 81.8 | 82.3 | 84.4 | 83.9 | 83.5 | 83.8 |

TABLE V

| Oxidation at 80° C. at 120 Minutes | Run | | | | | | |
|---|---|---|---|---|---|---|---|
| | 22 | 23 | 24 | 25 | 26 | 27 | 28 |
| Acid Catalyst | None | Formic | | | Phosphoric | | |
| Acid Catalyst Loading (wt %) | 0.00 | 1.0 | 2.5 | 5.0 | 1.0 | 2.5 | 5.0 |
| Reductions from Feed (%) | | | | | | | |
| Post-Oxidation Sulfur | 55.4 | 58.8 | 60.0 | 57.4 | 54.5 | 58.3 | 62.6 |
| Post-Extraction Sulfur | 64.4 | 64.6 | 66.4 | 62.9 | 70.4 | 67.5 | 73.3 |
| Post-Oxidation Nitrogen | 22.3 | 56.3 | 57.1 | 53.6 | 56.3 | 53.6 | 54.5 |
| Post-Extraction Nitrogen | 63.4 | 76.8 | 76.8 | 74.1 | 76.8 | 75.9 | 75.9 |
| Balances (%) | | | | | | | |
| Post-Oxidation Diesel | 106.1 | 104.4 | 104.8 | 103.2 | 102.8 | 104.2 | 106.1 |
| Post-Oxidation Aqueous HOAc | 70.2 | 70.1 | 89.6 | 62.9 | 67.2 | 58.2 | 72.9 |
| 1st 85% HOAc Extraction | 110.5 | 107.7 | 105.7 | 106.1 | 105.4 | 107.3 | 107.9 |
| 2nd 85% HOAc Extraction | 103.2 | 103.0 | 102.6 | 101.6 | 102.0 | 102.0 | 103.2 |

TABLE V-continued

| Oxidation at 80° C. at 120 Minutes | Run | | | | | | |
|---|---|---|---|---|---|---|---|
| | 22 | 23 | 24 | 25 | 26 | 27 | 28 |
| 3rd 85% HOAc Extraction | 102.0 | 101.2 | 101.4 | 102.8 | 101.0 | 102.4 | 101.6 |
| 1st Water Extraction | 105.0 | 104.9 | 105.1 | 105.2 | 105.4 | 106.1 | 104.8 |
| 2nd Water Extraction | 100.0 | 99.5 | 101.0 | 99.5 | 100.4 | 100.4 | 101.2 |
| 3rd Water Extraction | 100.3 | 100.6 | 100.3 | 100.9 | 100.3 | 99.4 | 99.6 |
| Diesel After Extractions | 83.1 | 84.6 | 85.1 | 85.8 | 84.3 | 84.7 | 83.6 |

The data organized in each table permit a direct comparison of desulfurization and denitrogenation due to no acid added, and formic acid and phosphoric acid additions in the oxidation zone under otherwise identical conditions. Table II contains data from the least severe set of oxidation conditions at 50° C. and 60 minutes. Even under these very mild conditions, the presence of the very low concentration of the acid catalyst proved to be beneficial to the process of the invention. For example, the addition of 5 wt % phosphoric acid resulted in an increase in desulfurization following extraction from 25% (Run 1) to 50% (Run 7).

Table IV shows the data from a set of experiments identical to Table II except that the oxidation temperature was increased from 50 to 80° C. The level of desulfurization was increased slightly under these conditions. The addition of an acid catalyst provided a higher level of denitrogenation than in Run 15 where no acid catalyst was used. Overall, the denitrogenation level at 80° C. was not much better than the 50° C. experiments after 60 minutes.

A comparison of the data set forth in Table II with Table IV clearly show that increasing the temperature serves to increase the desulfurization. Apparently, the addition of more than 1 wt % of acid catalyst brings about only slightly improved results at both temperatures. Both acid catalysts at 50 and 80° C. gave essentially the same results.

A comparison of Tables II and III wherein the temperature was fixed at 50° C. while the reaction time was increased from 60 to 120 minutes showed that the reaction time did not make much difference in terms of desulfurization at this temperature except when 5% acid catalyst was used where a higher level of desulfurization was observed. However, by allowing the reaction to proceed for 120 minutes the increased residence time permitted the oxidation with no acid catalyst runs to provide equivalent results with the acid-catalyzed experiments.

A comparison of Tables IV and V where the temperature was fixed at 80° C. but resident time varied from 60 to 120 minutes reveals that phosphoric acid was superior at 80° C. and 120 minutes. Formic acid did not provide any advantages under these higher temperature and longer reaction time cases. At a shorter reaction time, again, one weight percent acid catalyst provided the optimum results.

A comparison of the denitrogenation data between Table II and Table IV where the temperature was varied at 50 and 80° C. for 60 minutes reveal that there was a benefit from the use of a catalyst only at 80° C. versus the control. Once the temperature was established at 50° C. for 60 minutes, the catalyst was not a factor.

A comparison of the denitrogenation data set forth in Tables III and V where the residence time was fixed at 120 minutes, but the temperature varied from 50 to 80° C., showed that high denitrogenation was achieved at 80° C. and 120 minutes with the addition of one weight percent phosphoric acid. Increasing the acid concentration appeared to decrease the denitrogenation.

In every run the mass balance showed that the diesel layer after the oxidation was invariably higher than 100%. The swelling of the diesel layer is likely to be due to its adsorption of acetic acid. The loss of acetic acid to the diesel layer does not account for all of the losses of acetic acid from the oxidation, however. It is believed that the acetic acid and water were most likely lost as a result of the stripping action of the nitrogen sweep at reaction temperature. An accumulation of a colorless liquid downstream from the reflux condenser was observed. It is believed this material was most likely the missing acetic acid/water.

The 1$^{st}$ 85% HOAc extraction balance was the highest in comparison to the subsequent second and third extractions. It is believed that the higher balance from the 1$^{st}$ extraction comes from the back-extraction of the oxidation acetic acid from the diesel layer. However, the back extraction is not entirely successful because the 1$^{st}$ D&D water extraction had the highest balance within the water-extraction set. The high balance is due to the removal of acetic acid. Subsequent water extractions resulted in mass balance returning to nearly 100%. Overall, the diesel balance was fair; on average 85% of the original diesel by weight was recovered. The remaining diesel was probably extracted by the solvents, which can be recovered by conventional means.

EXAMPLE 2

The following Table VI shows a comparison between a Run 28 and Run 29 carried as set forth in Example 1. However, Run 29 was carried at a higher oxidation temperature—100° C. and without the use of an acid catalyst.

TABLE VI

| Comparison of Unoptimized and Optimized Oxidation Conditions | Run | |
|---|---|---|
| | 29 | 28 |
| Catalyst | None | 5 wt % $H_3PO_4$ |
| $H_2O_2$ Conc. in Diesel (ppm) | 1,463 | 1,010 |
| Temperature (° C.) | 100 | 80 |
| Time (min) | 120 | |
| Post-Ox S (ppm) | 127 | 129 |
| Post-Ex S (ppm) | 96 | 92 |
| Desulfurization (%) | 72 | 73 |

By adding 5 wt % phosphoric acid and reducing the temperature to 80° C., it is possible to significantly reduce the hydrogen peroxide usage by 45% to provide a constant level of desulfurization.

EXAMPLE 3

The same diesel fuel used in Example 1 was also used in the instant example. The process conditions for the oxidation are summarized in Table VII.

TABLE VII

| Process Conditions for Hydrogen Peroxide Optimized Study | |
|---|---|
| Parameter | Targeted Level |
| Protic Acid | Phosphoric |
| Acid Concentration (wt % in Feed) | 1 |
| Diesel (g) | 300 |
| Glacial HOAc (g) | 300 |

TABLE VII-continued

| Process Conditions for Hydrogen Peroxide Optimized Study | |
|---|---|
| Parameter | Targeted Level |
| D&D Water (g) | 25.5 |
| Temperature (° C. and ° F.) | 80, 176 |
| Time (min) | 120 |
| 30% $H_2O_2$ Loading (g) | Variable |

The experimental procedure was the same as set forth in Example 1. Hydrogen peroxide stoichiometric excess molar ratios explored in range from 0 to 200% or 1,010 to 3,030 ppm hydrogen peroxide in diesel feed. To examine the contributions made by the acid catalyst, the runs were also carried out in the absence of an acid catalyst in order to provide a direct comparison.

To study the impact of water concentration in the extraction stage, the extraction of the same influent to the extraction stage with three different aqueous acetic acid solvents having acetic acid concentrations of 75, 85, and 95% were also carried out. Following the aqueous acetic acid extractions, the diesel layer was then extracted with three portions of D&D water.

Table VIII summarizes oxidation step and extraction step results for both phosphoric and non-acid catalyzed oxidation of the diesel feed using an increasing loading of hydrogen peroxide.

TABLE VIII

Oxidative Desulfurization Results as a Function of Acid-Catalysis and Hydrogen Peroxide Stoichiometry

| | Run | | | | | | | | | |
|---|---|---|---|---|---|---|---|---|---|---|
| | 1 | 2 | 3 | 4 | 5 | 6 | 7 | 8 | 9 | 10 |
| | 030 | 080 | 103 | 091 | 106 | 094 | 109 | 097 | 112 | 100 |
| Acid Catalysis? | No | Yes | No | Yes | No | Yes | No | Yes | No | Yes |
| $H_2O_2$/S + N | 1X | | 1.5X | | 2.0X | | 2.5X | | 3.0X | |
| $H_2O_2$ in Diesel (ppm) | 1,010 | | 1,515 | | 2,020 | | 2,525 | | 3,030 | |
| Reduction from Feed (%) | | | | | | | | | | |
| Post-OX Sulfur (Stage-1) | 55.4 | 54.5 | 58.8 | 66.7 | 62.6 | 71.6 | 67.5 | 69.9 | 72.5 | 68.7 |
| Post-Ex Sulfur (Stage-2) | 64.4 | 70.4 | 71.0 | 84.4 | 80.3 | 90.4 | 87.5 | 93.6 | 91.6 | 94.2 |
| Post-Ox Nitrogen (Stage-1) | 22.3 | 56.3 | 56.3 | 58.0 | 53.6 | 62.5 | 58.9 | 65.2 | 65.2 | 69.6 |
| Post-Ex Nitrogen (Stage-2) | 63.4 | 76.8 | 78.6 | 80.4 | 53.6 | 81.3 | 80.4 | 83.0 | 82.1 | 85.7 |
| Material Balances (%) | | | | | | | | | | |
| Post-Oxidation Diesel | 106 | 102 | 105 | 106 | 105 | 105 | 105 | 105 | 105 | 105 |
| Post-Oxidation Aq. HOAc | 70.2 | 67 | 73.2 | 75.7 | 65 | 79.2 | 70.7 | 77.1 | 89 | 79.0 |
| 1st 85% HOAc | 111 | 105 | 108 | 112 | 111 | 108 | 107 | 113 | 107 | 111 |
| 2nd 85% HOAc | 103 | 102 | 103 | 105 | 102 | 103 | 103 | 104 | 103 | 103 |
| 3rd 85% HOAc | 102 | 101 | 102 | 102 | 101 | 102 | 102 | 101 | 102 | 103 |
| 1st Water | 105 | 105 | 106 | 106 | 106 | 106 | 106 | 104 | 105 | 106 |
| 2nd Water | 100 | 100 | 99 | 100 | 99 | 98.2 | 99.5 | 99.1 | 99.2 | 100 |
| 3rd Water | 100.3 | 100 | 100 | 102 | 99.1 | 101 | 99.5 | 101 | 99.8 | 99.4 |
| Final Diesel Balance (%) | 83.1 | 84.3 | 85.1 | 80.0 | 83.8 | 84.2 | 84.1 | 81.2 | 84.4 | 81.3 |

Figure 2:
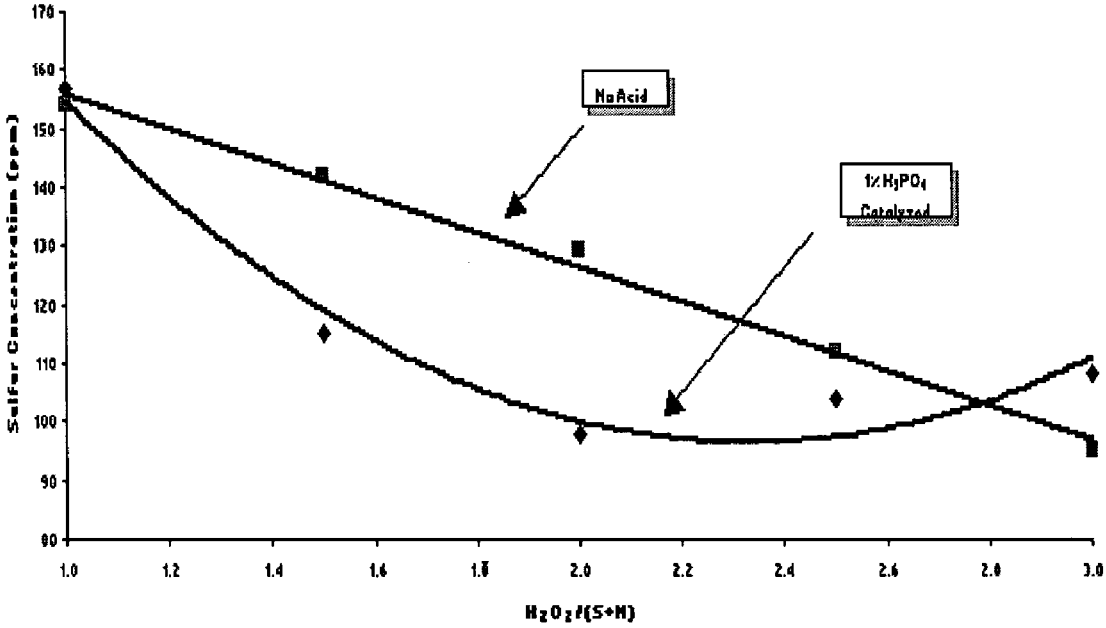
FIG. 2 shows the sulfur concentrations in the oxidation step effluent for the acid catalyzed oxidation and non acid catalyzed oxidation embodiments of the present invention.

From the run data it is apparent in the post-oxidation examination of the product that the sulfur concentration is very similar in both acid and non-acid catalysis at a constant peroxide loading. In both sets of runs, there is a downward trend in the overall sulfur concentration as the peroxide concentration increases. However, the sulfur analysis does not discriminate between oxidized and unoxidized sulfur compounds dissolved in the diesel layer. With the exceptions of Runs 1 and 2, the same can be said of nitrogen species after oxidation. FIG. 2, depicts a plot of the residual sulfur concentration in the post-oxidized diesel for both the catalyzed and non-catalyzed series. There is a gap between two curves with the upper curve belonging to the no catalyst series of runs. As the peroxide loading increased, the desulfurization difference between acid catalyzed and no acid catalyst series began to decrease. In no case did any oxidation step effluent contain less than 95 ppm sulfur.

Figure 3:
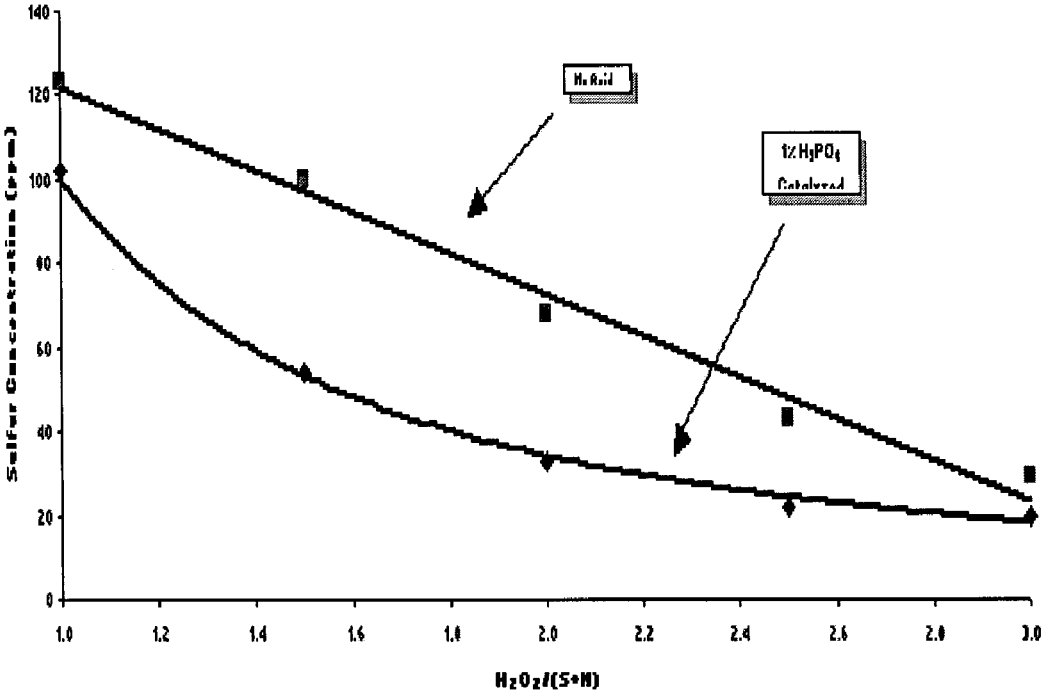
FIG. 3 shows the sulfur concentrations in the extraction step effluent for the acid catalyzed oxidation and non-acid catalyzed oxidation embodiments of the present invention.

After a sequence of 85% aqueous acetic acid and D&D water extractions, a greater reduction is observed in the sulfur and nitrogen concentrations. In general, a steeper reduction in sulfur concentration is observed as the peroxide loading is increased. FIG. 3 depicts a plot of the sulfur concentration in the extraction step effluent.

As in FIG. 3, a gap also appears between the catalyst and no catalyst series of runs. The acid catalyst curve in FIG. 3 shows a more aggressive reduction in sulfur concentration, but the sulfur concentration began to level out near 20 ppm sulfur (94% sulfur reduction) with three times the stoichiometric requirement for peroxide. Correspondingly, at three times the peroxide and no acid catalyst, the product contained 29 ppm which represents a 92% sulfur reduction.

The gap between oxidation step effluent and extraction step effluent sulfur concentration for the acid-catalyzed series (FIG. 4) and the non-acid catalyzed series (FIG. 5) are also plotted. The gap between the oxidation step sulfur and extraction step sulfur widens substantially as the peroxide loading increased. The difference is plotted as a curve superimposed in these bar graphs.

Figure 4:
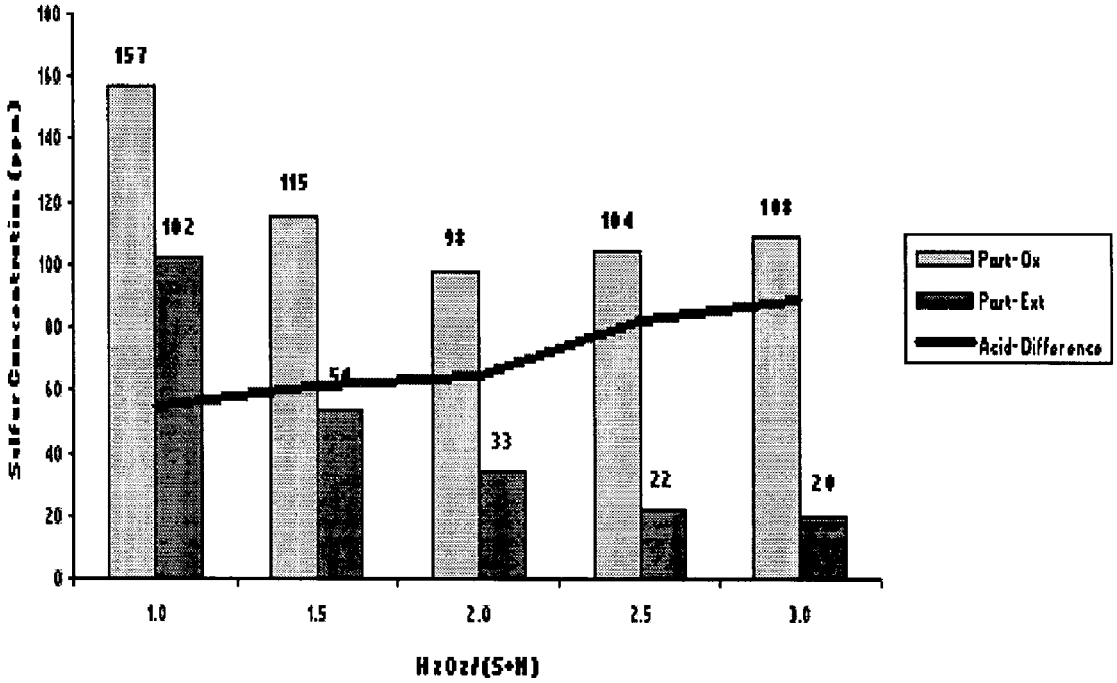
FIG. 4 shows the difference between sulfur concentrations in the oxidation effluent and the extraction effluent for the acid catalyzed oxidation embodiment of the invention.
Figure 5:
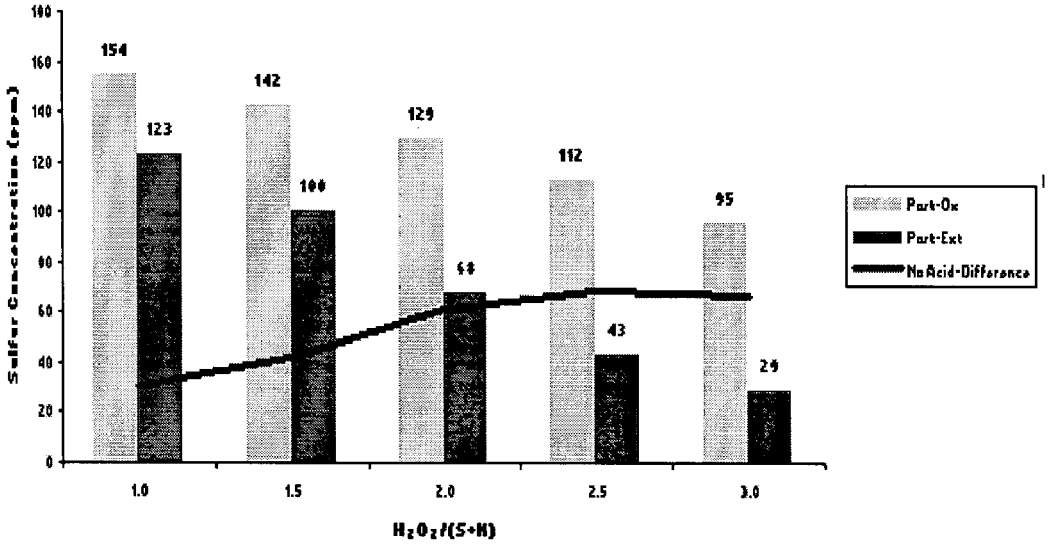
FIG. 5 shows the difference between sulfur concentrations in the oxidation effluent and the extraction effluent for the non-acid catalyzed oxidation embodiment of the invention.
Figure 6:
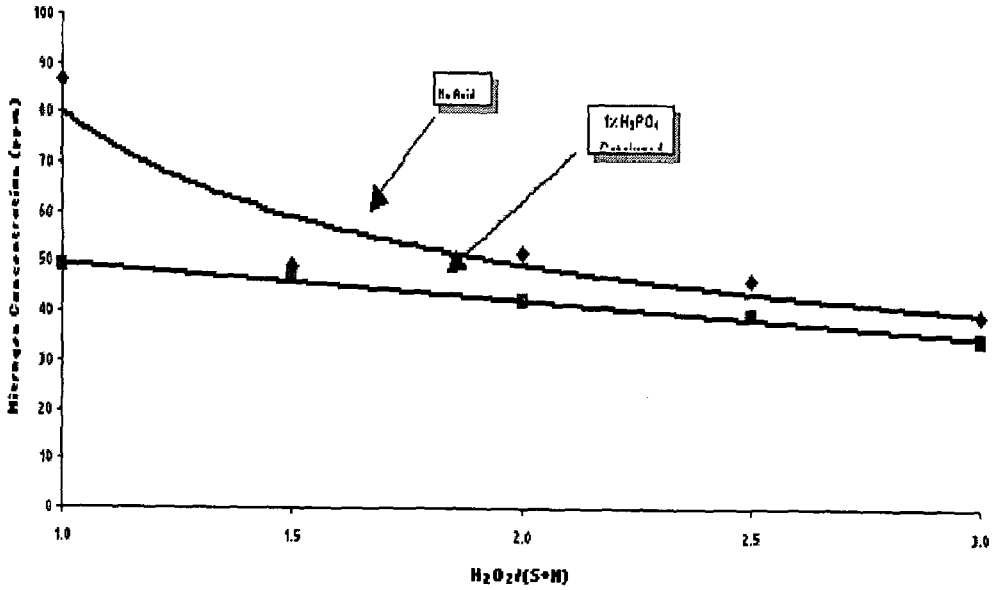
FIG. 6 shows the difference in nitrogen concentrations in the oxidation zone effluent for the acid catalyzed and non-acid catalyzed oxidation embodiments of the invention.

FIGS. 4 and 5 show that the diesel is still a good solvent for oxidized sulfur compounds. In FIG. 4, oxidation step effluent that contained 98 ppm sulfur, the lowest sulfur level, did not produce the lowest sulfur concentration in extraction step effluent. FIG. 6 shows the denitrogenation benefits from an increase in the peroxide concentration and catalyst addition. Between the acid-catalyzed and non-catalyzed series, the former was better for nitrogen removal.

EXAMPLE 4

A large quantity of oxidation products using only 1× hydrogen peroxide (1010 ppm hydrogen peroxide in diesel was prepared in accordance with the procedure set forth in Example 1. The water concentration in the liquid-liquid extractions was varied. The influent to the extraction step contained 135 ppm sulfur and 55 ppm nitrogen.

An aliquot (100 g) of this material was extracted 3×50 g portions of 95, 85, and 75% aqueous acetic acid. Following these extractions, the diesel fraction was then extracted with three 50 g portions of distilled and dionized (D&D) water to remove residual acetic acid. The results are summarized in Table IX below.

TABLE IX

Variable Water Concentration in Acetic Acid Extractions of Oxidative Desulfurization of diesel using 1 wt % Phosphoric Acid and Stoichiometric Hydrogen Peroxide, 120 minutes, 80° C.

| | Run | | |
|---|---|---|---|
| | 1 | 2 | 3 |
| Oxidation Results | | | |
| Sulfur (ppm) | | 135 | |
| Nitrogen (ppm) | | 55 | |
| Aqueous Acetic Acid (wt %) | 95 | 85 | 75 |
| Extracted Diesel Results | | | |
| Sulfur (ppm) | 92 | 112 | 116 |
| Nitrogen (ppm) | 12 | 26 | 29 |
| Reduction from Feed | | | |
| Sulfur (%) | 73.3 | 67.5 | 66.4 |
| Nitrogen (%) | 89.3 | 76.8 | 74.1 |
| Mass Balances (%) | | | |
| HOAc-1 | *103 | 111 | 113 |
| HOAc-2 | 110 | 103 | 102 |
| HOAc-3 | 109 | 102 | 101 |
| Water-1 | 108 | 105 | 104 |

TABLE IX-continued

Variable Water Concentration in Acetic Acid Extractions of Oxidative Desulfurization of diesel using 1 wt % Phosphoric Acid and Stoichiometric Hydrogen Peroxide, 120 minutes, 80° C.

| | Run | | |
|---|---|---|---|
| | 1 | 2 | 3 |
| Water-2 | 99 | 100 | 101 |
| Water-3 | 103 | 98.4 | 98.7 |
| Final Diesel Balance (%) | 71.5 | 83.7 | 84.4 |

*insufficient settling of acetic acid layer

In general, 95% aqueous acetic acid gave the highest degree of desulfurization, but not much higher than 85 and 75% concentrations. The detriment of the 95% acetic acid is over-extraction. The second and third 95% acetic acid extraction mass balances are higher than the second and third extraction balances for 85 and 75% acetic acid. The higher mass balances can be explained by over-extraction of the diesel, causing the acetic acid fraction to swell. The first extraction for 95% acetic acid produced an unusually low balance for the first extraction due to insufficient settling of acetic acid layer so more acetic acid remained in diesel. Note that second outer and extraction balance was very high.

The table also reveals that increasing the water concentration in the solvent decreased the level of sulfur removal, but also left behind more diesel. The trade-offs are significant in this process. The water extraction balances are the highest for the 95% acetic acid extractions. These results indicate a significant back extraction of retained acetic acid in the diesel.

That which is claimed is:

1. A process for desulfurizing hydrocarbon feedstock to produce refinery transportation fuel or blending components for refinery transportation fuel, wherein said feedstock contains sulfur-containing organic impurities and/or nitrogen-containing organic impurities which process comprises:

(a) contacting the feedstock with an immiscible phase comprising acetic acid, water, and an oxidizing agent comprising hydrogen peroxide and a protic acid not containing sulfur or nitrogen in an oxidation zone at oxidation zone conditions to oxidize sulfur-containing and/or nitrogen-containing organic compounds;

(b) separating at least a portion of the immiscible phase containing oxidized sulfur-containing and/or nitrogen-containing organic compounds to form a first hydrocarbon stream having a reduced content of oxidized sulfur-containing and/or nitrogen containing compounds;

(c) contacting at least a portion of the first hydrocarbon stream with a solvent comprising acetic acid and water in a liquid-liquid extraction zone to produce an extract stream containing at least a portion of the oxidized sulfur-containing and/or nitrogen-containing organic compounds and a raffinate second hydrocarbon stream containing a reduced amount of oxidized sulfur-containing organic compounds and/or nitrogen-containing organic compounds; and (d) recovering the second hydrocarbon stream.

2. The process of claim 1 wherein the protic acid is present in an amount ranging from about 0.5 wt. % to about 10.0 wt. %.

3. The process of claim 1 wherein the protic acid is phosphoric acid and wherein the phosphoric acid Is present in an amount ranging from about 1 wt. % to about 3 wt. %.

4. The process of claim 1 wherein the stoichiometric ratio of hydrogen peroxide to sulfur plus nitrogen in the hydrocarbon feedstock ranges from about 1 to 1 to about 2 to 1.

5. The process of claim 1 wherein the oxidation zone conditions include a temperature lower than about 90° C.

6. The process of claim 1 wherein the oxidation conditions include a residence time ranging from about 1 minute to about 180 minutes.

7. The process of claim 1 wherein the acetic acid used in the oxidation zone is present in an amount ranging from about 80 wt. % to about 99 wt. % based on the weight of the immiscible phase.

8. The process of claim 1 wherein the solvent used in the liquid-liquid extraction zone contains about 70 wt % to about 92 wt. % acetic acid.

9. The process of claim 1 wherein the second hydrocarbon stream is passed to a second liquid-liquid extraction zone wherein the second hydrocarbon stream is contacted with a solvent comprising water to produce a raffinate third hydrocarbon stream and an extract water stream containing acetic acid.

10. The process of claim 1 wherein at least a portion of the hydrocarbon feedstock is a product of a hydrotreating process for petroleum distillate, which hydrotreating process includes reacting the petroleum distillate with a source of hydrogen at hydrogenation conditions in the presence of a hydrogenation catalyst to assist by hydrogenation removal of sulfur and/or nitrogen from the petroleum distillate.

11. The process of claim 1 wherein the immiscible phase and the extract stream are passed to a separation zone wherein acedic acid is separated and recovered from the oxidized sulfur-containing organic compounds and/or nitrogen-containing compounds.

12. The process of claim 1 wherein the oxidizing agent additionally comprises phosphoric acid in an amount ranging from about 1 wt. % to about 3 wt. %; the oxidation zone conditions include a temperature lower than about 90° C.; the acetic acid used in the oxidation zone is present in an amount ranging from about 95 wt. % to about 99 wt. % based on extraction the weight of the immiscible phase; the solvent used in the liquid-liquid zone comprises about 85 wt. % to about 92 wt. %; and the stoichiometric ratio of hydrogen peroxide to sulfur plus nitrogen ranges from about 1 to 1 to about 2 to 1.

13. The process of claim 12 wherein at least a portion of the hydrocarbon feedstock is a product of a hydrotreating process for petroleum distillate, which hydrotreating process includes reacting the petroleum distillate with a source of hydrogen at hydrogenation conditions in the presence of a hydrogenation catalyst to assist by hydrogenation removal of sulfur and/or nitrogen from the petroleum distillate.

* * * * *